United States Patent [19]

Paripovich

[11] 4,326,311

[45] Apr. 27, 1982

[54] SELF-RELEASING LOCKING UNIT FOR AN INNER SPRING ASSEMBLY

[76] Inventor: Michael D. Paripovich, 109 Flanders, Chickasha, Okla. 73018

[21] Appl. No.: 148,955

[22] Filed: May 12, 1980

[51] Int. Cl.[3] ..... A47C 23/04; A47C 31/08

[52] U.S. Cl. ..... 5/475; 5/260

[58] Field of Search ..... 5/260, 259, 466, 474, 5/475, 246

[56] References Cited

U.S. PATENT DOCUMENTS

| | | | |
|---|---|---|---|
| 2,709,819 | 6/1955 | Wise | 5/260 X |
| 3,093,840 | 6/1963 | Martin | 5/474 X |
| 3,391,412 | 7/1968 | Bronstien, Jr. et al. | 5/474 X |
| 3,426,371 | 2/1969 | Robinson | 5/260 |
| 3,590,404 | 7/1971 | Dreve, Jr. | 5/474 X |
| 3,971,082 | 7/1976 | Crosby et al. | 5/260 |
| 4,067,076 | 1/1978 | Krier | 5/474 |

*Primary Examiner*—Stephen J. Novosad

*Attorney, Agent, or Firm*—Dunlap, Codding & McCarthy

[57] ABSTRACT

An improved self-releasing locking unit, such as a self-releasing locking edge support, in an inner spring assembly wherein the locking unit can be employed to secure the inner spring assembly in a compressed condition during the covering of same, and which will release the inner spring assembly from the compressed condition after the covering procedure has been completed. The self-releasing locking unit comprises a hook connected to the peripheral lower frame of the inner spring assembly and a hook receiver connected to an upper portion of the inner spring assembly. The hook is biased in a first position near the lower frame and is movable to a second position wherein the hook is disposed substantially normal to the plane of the lower frame and is adapted to engage the hook when the lower and upper frames of the inner spring assembly are in a compressed condition. The hook receiver releases the hook when the lower and upper frames are further compressed so that the hook can return to the first position and the lower and upper frames of the inner spring assembly can expand.

35 Claims, 14 Drawing Figures

SELF-RELEASING LOCKING UNIT FOR AN INNER SPRING ASSEMBLY

BACKGROUND OF THE INVENTION

1. Field of the Invention

This invention relates generally to inner spring assemblies, and more particularly, but not by way of limitation, to inner spring assemblies having self-releasing locking units for selectively retaining the inner spring assembly in a compressed condition during the covering of same, the self-releasing locking units being capable, after the inner spring unit has been covered, of being released so that the inner spring unit can expand. In one aspect, the present invention relates to an improved edge support for strengthening and supporting the peripheral edge portion of an inner spring assembly wherein the edge support is further adapted to temporarily secure the inner spring assembly in the compressed condition while enabling one to release the spring assembly from the compressed condition after the spring assembly has been covered.

2. Description of Prior Art

The peripheral edge portion of inner spring assemblies used in the manufacture of furniture, such as bed springs, mattresses, sofas, and the like, are generally subjected to heavier loads than the central portion of such furniture due to the habit of people sitting on the edge of the furniture and consequently concentrating their entire weight over a limited area. To strengthen and support the peripheral edge portion of the spring assemblies a plurality of edge supports have heretofore been disposed around the peripheral frames of the spring assemblies in an effort to overcome the beforementioned problem. This technique of using edge supports around the peripheral frames of spring assemblies has met with considerable success. However, problems have been encountered when upholstering or covering an inner spring assembly, especially an inner spring assembly employing the beforementioned edge supports, in that the cover is often loosely fitted and thus does not have the desired amount of tension, and the covered product does not have a uniform structure and appearance.

In an effort to overcome the above-mentioned problems in the upholstering and manufacturing of furniture containing inner spring assemblies numerous methods and devices have been heretofore suggested. However, such methods and devices have not met with any substantial success in that they are generally complex, require a substantial deforming of the inner spring assembly during the upholstering operation, and are expensive and complicated in use. Thus, a need has long existed for an improved locking unit for retaining inner spring assemblies in a compressed condition during the upholstering or covering of same wherein the locking unit can be easily released once the upholstering or covering procedure has been completed without damaging the finished product or requiring further operational steps.

SUMMARY OF THE INVENTION

An object of the present invention is to provide a new and improved inner spring assembly having a locking unit for retaining the inner spring assembly in a compressed condition during the upholstering of same.

Another object of the present invention is to provide a self-releasing locking unit for an inner spring assembly wherein the locking unit can be released after the upholstering procedure has been completed so that the inner spring assembly can expand.

Another object of the present invention is to provide an improved self-releasing locking unit for use in the construction of furniture having an inner spring assembly which is simple in construction, durable, and which can be employed to secure the inner spring assembly in a compressed condition and thereafter release the compressed inner spring assembly so that the inner spring assembly can expand without requiring the releasing of the self-releasing locking unit to be achieved prior to the completion of the upholstering operation.

Another object of the invention is to provide an improved self-releasing locking unit for use in an inner spring assembly which can also be employed for reinforcing the peripheral edge portion of the inner spring assembly.

Another object of the invention is to provide an improved edge support for use in the construction of furniture containing an inner spring assembly wherein the edge support can be employed to secure the inner spring assembly in a compressed condition during the upholstering of same.

Another object of the present invention is to provide an improved self-releasing locking unit for use in combination with an edge support which does not contain the deficiencies of the units heretofore known.

These and other objects, advantages, and features of the present invention will be apparent to those skilled in the art from a reading of the following detailed description when read in conjunction with the drawings which accompany this disclosure and with the appended claims.

According to the present invention an improved self-releasing locking unit for use with an inner spring assembly is provided wherein the locking unit can be employed to secure the inner spring assembly in a compressed condition during the covering of same, and which will release the inner spring assembly from the compressed condition after the covering procedure has been completed. Broadly, the self-releasing locking unit of the present invention comprises a hook connected to the peripheral lower frame of the inner spring assembly and a hook receiver connected to an upper portion of the inner spring assembly. The hook is biased in a first position near the lower frame and is movable to a second position wherein the hook is disposed substantially normal to the plane of the lower frame. The hook receiver is connected to the peripheral upper frame of the inner spring assembly and is adapted to engage the hook when the hook is in the second position and the lower and upper frames of the inner spring assembly are in a compressed condition. The hook receiver is further adapted to release the hook when the lower and upper frames are further compressed so that the hook can return to the first position and the lower and upper frames of the inner spring assembly can expand.

Further according to the present invention an improved edge support for use with an inner spring assembly is provided wherein the edge support is secured to the peripheral lower frame and the peripheral upper frame of the inner spring assembly. The improved edge support comprising a resilient member, a hook, and a hook receiver. The resilient member is provided with a first end portion, a spatially disposed second end portion, and a medial resilient portion extending therebetween so that upon connecting the edge support to the peripheral lower frame and the peripheral upper frame of the inner spring assembly via the first end portion and the second end portion, respectively, the resilient member and the lower and upper frames can be moved to a compressed condition. The hook, which is connected to the first end portion of the resilient member, is biased in a first position wherein the hook is disposed substantially adjacent the plane of the lower frame; and the hook is movable from the first position to a second position wherein the hook is disposed substantially normal to the plane of the lower frame. The hook receiver, which is formed on one of the second end portion and the medial portion of the resilient member, is alignable with the hook and adapted to engage the hook when the hook is in the second position and the lower and upper frames of the inner spring assembly are in the compressed condition. The hook receiver is further adapted to release the hook when the lower and upper frames are further compressed so that the hook can return to its first position and the lower and upper frames of the inner spring assembly, together with the medial resilient portion of the edge support, can expand.

DESCRIPTION OF PREFERRED EMBODIMENTS

The present invention will find application in connection with inner spring mattresses, inner spring cushions, and the like, and in other instances where spring steel constructions or assemblies, generally known as inner spring units, are used. However, for purposes of illustration the present invention is illustrated with an inner spring assembly used in connection with an inner spring mattress.

Figure 1:
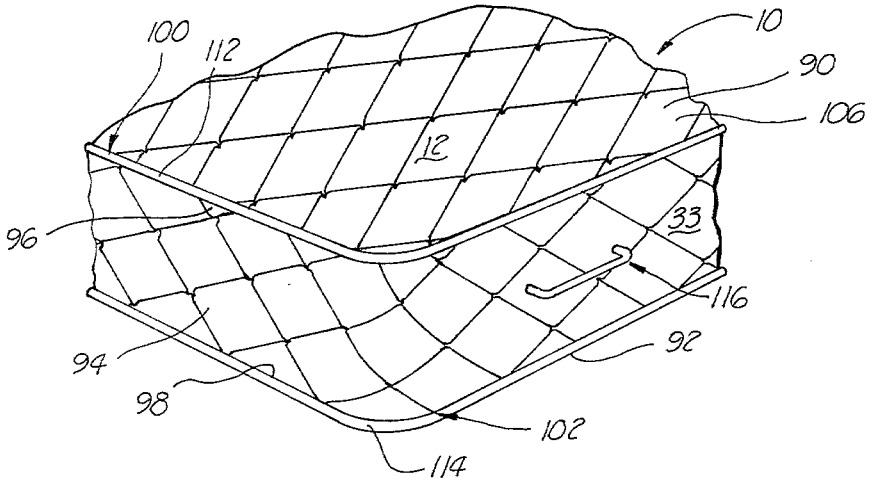
FIG. 1 is a perspective view of a corner portion of an inner spring mattress.
Figure 4:
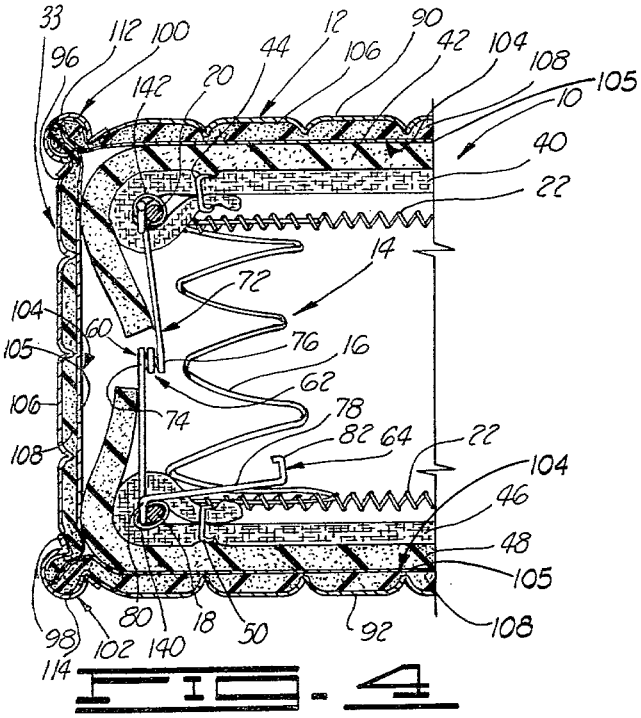
FIG. 4 is a fragmentary cross-sectional view of a mattress having an inner spring assembly in combination with the edge support of the present invention, the inner spring assembly being illustrated in an expanded position, and an end view of the improved edge support being illustrated wherein the hook of the edge support is biased in the first position.
Figure 7:
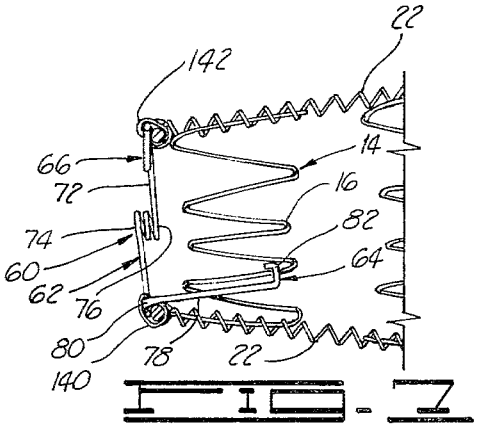
FIG. 7 is a fragmentary cross-sectional view of the inner spring assembly and edge support of FIG. 6, wherein the inner spring assembly and the edge support are in the compressed condition, an end view of the edge support being illustrated in which the hook of same is biased in the first position.
Figure 8:
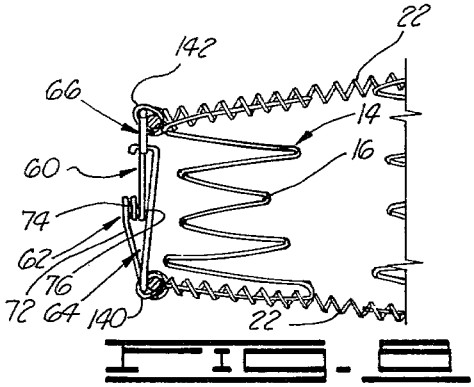
FIG. 8 is a fragmentary view of the inner spring assembly and edge support of FIG. 7 wherein the hook of the edge support is disposed in the second position and engaging the hook receiver of the edge support for securing the inner spring assembly in the compressed condition.

Referring to the drawings, and more specifically to FIGS. 1 and 4, a mattress 10 is depicted which comprises a cover 12 and an inner spring assembly 14. The inner spring assembly 14 comprises a plurality of spring coils, such as spring 16, a peripheral lower frame 18, and a peripheral upper frame 20. In the conventional inner spring assembly 14, employed in the construction of the mattress 10, the lower frame 18 and the upper frame 20 are substantially rectangular shaped frames and are secured in spaced relationship via the coil springs, such as spring 16, and a plurality of longitudinal and transverse metal straps, such as members 22 illustrated in FIGS. 4, 7 and 8. These metal straps interconnect the coil springs, such as spring 16, of the mattress 10. The lower end portions of the coil springs disposed adjacent the lower frame 18, such as spring 16, are secured to the lower frame 18 by any suitable means, such as helical member 23. Similarly, the upper end portion of the coil springs disposed adjacent the upper frame 20, such as spring 16, are secured to the upper frame 20 by any suitable means, such as helical member 24.

Figure 10:
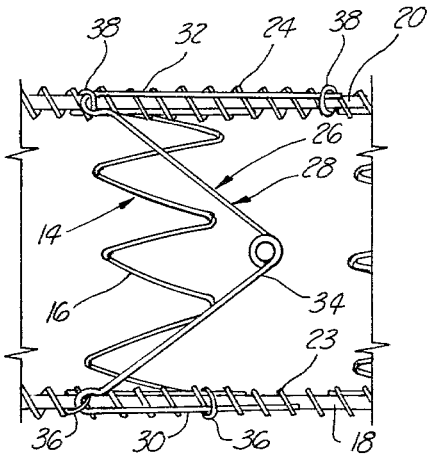
FIG. 10 is a fragmentary view of an inner spring assembly illustrating a side view of a prior art edge support for strengthening and supporting the peripheral edge portion of an inner spring assembly.

In order to strengthen and support the peripheral edge of the mattress 10, and thus the lower frame 18 and the upper frame 20 of the inner spring assembly 14, an edge support 26 is connected to the lower and upper frames 18, 20 as shown in FIG. 10. The edge support 26 comprises a resilient member 28 having a first end portion 30, a spatially disposed second end portion 32 and a medial portion 34. The first end portion 30 of the edge support 26 is secured to the lower frame 18 of the inner spring assembly 14 via a plurality of compressed ring members 36; and the second end portion 32 is secured to the upper frame 20 of the inner spring assembly 14 via a plurality of compressed ring members 38. Thus, the medial portion 34 of the edge support 26 (which strengthens and supports the peripheral edge of the mattress 10) is disposed between the lower and upper frames 18, 20 of the inner spring assembly 14 substantially as shown. The inner spring assembly 14 so formed is thereafter covered by a cover 12a (see FIG. 3) to provide a conventional mattress.

In normal construction of a mattress the upper frame 20 of the inner spring assembly 14, and thus the various components disposed within the boundaries of the upper frame 20, (such as the spring 16, the helical member 24, the longitudinal and transverse metal straps, such as the members 22, and the edge support 26) are covered with a plurality of pads, such as pads 40, 42 which are disposed across the upper frame 20 and positioned around the upper frame 20 substantially as shown in FIG. 4. Thereafter, one or both of the pads 40, 42 can be secured to the upper frame 20, the spring 16, or edge support 26 disposed adjacent the upper frame 20. For example, pad 40 can be positioned over and looped around the upper frame 20 and thereafter secured thereon by a compressed ring member 44. Pad 42 can then be positioned over pad 40 and allowed to extend down a side portion 33 of the mattress 10 to protect the cover from the edge support 26 or an adjacently disposed spring 16.

Similarly, the lower frame 18 of the inner spring assembly 14, and thus the various components disposed within the boundaries of the lower frame 18 (such as the spring 16, the helical member 23, the longitudinal and transverse metal straps, such as members 22, and the edge support 26) are covered with a plurality of pads, such as pads 46, 48 which are disposed across the lower frame 18 and positioned around the lower frame 18 as shown in FIG. 4. Thereafter, one or both of the pads 46, 48 can be secured to the lower frame 18, one of the adjacently disposed springs 16, or the edge support 26. For example, pad 46 can be positioned over and looped around the lower frame 18 and thereafter secured thereon by a compressed ring member 50. Pad 48 can then be positioned adjacent pad 46 and allowed to extend up along the side portions, such as the side portion 33, of the mattress to protect the cover from the edge support 26 or an adjacently disposed spring 16.

Once the desired padding has been positioned upon and secured to the lower and upper frames 18, 20 of the inner spring assembly 14 as hereinbefore set forth, the padded inner spring assembly 14 is then covered with the cover 12a (illustrated in FIG. 3) to provide a finished mattress product having an appearance similar to the mattress 10.

The foregoing discussion and description of the construction of a mattress, including the inner spring assembly 14 and the edge support 26, are conventional in the art. The mattress cover 12a (shown in FIG. 3) is the conventional cover used in the construction of the mattress 10; whereas the cover 12 (shown in FIG. 2) is a cover fabricated using a high tensile strength backing material as will be described hereinafter. The mattress 10 depicted in FIGS. 1 and 4 is constructed with the mattress cover 12. However, as previously stated, problems have been encountered when positioning any type of a cover on the padded inner spring assembly 14, especially when one desires to compress the peripheral edge portions of the lower and upper frames 18, 20 of the inner spring assembly 14 and maintain same in the compressed condition during the covering process.

Referring now to FIGS. 4–9 and 11 an improved edge support 60 is provided which, when attached to the inner spring assembly 14 via the lower frame 18 and the upper frame 20 thereof, enables one to compress the lower frame 18 and the upper frame 20 and maintain same in a compressed condition until the inner spring assembly 14 has been covered with the cover 12. To accomplish this purpose, a plurality of the improved edge supports 60 are disposed along and connected to the lower and upper frames 18, 20 of the inner spring assembly 14 in the same manner in which the prior art edge supports 26 (see FIG. 10) have been employed.

The improved edge support 60 of the present invention, while functioning to strengthen and support the peripheral upper frame 20 and the lower frame 18 of the inner spring assembly 14 (and thus the peripheral edge portions of the mattress 10), is further adapted to temporarily secure the lower and upper frames 18, 20 of the inner spring assembly 14 in the compressed condition during the covering of same with the cover 12. However, once the inner spring assembly 14 has been substantially encapsulated by the cover 12, the lower and upper frames 18, 20 of the inner spring assembly 14 can be further compressed whereupon the lower and upper frames 18, 20 of the inner spring assembly 14 are allowed to expand within the confines of the cover 12 of the mattress 10.

Figure 5:
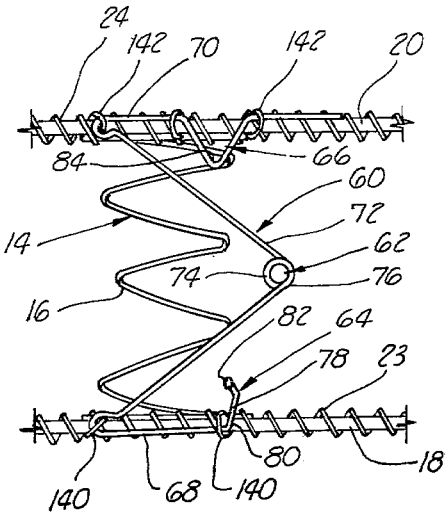
FIG. 5 is a fragmentary side view of an inner spring assembly having the improved edge support of the present invention connected thereto, the inner spring assembly, including the edge support, being depicted in an expanded condition, and the hook of the edge support being depicted in the biased first position.

The improved edge support 60 of the present invention comprises a resilient member 62, a hook 64, and a hook receiver 66. The resilient member 62, a spring-like member, is provided with a first end portion 68, a spatially disposed second end portion 70, and a medial portion 72 extending therebetween. The first end portion 68 of the resilient member 62 is disposed substantially adjacent and is connected to a portion of the lower frame 18; and the second end portion 70 of the resilient member 62 is disposed substantially adjacent and is connected to a portion of the upper frame 20. The medial portion 72 of the resilient member 62, which permits the lower and upper frames 18, 20 to be moved from the expanded condition to a compressed condition, is angularly disposed with respect to the elongated axis of the first and second end portions 68, 70 of the resilient member 62. The angular disposition of the medial portion 72 of the resilient member 62, with respect to the first and second end portions 68, 70 of the resilient member 62, improves the resilient properties of the medial portion 72 of the resilient member 62. Preferably, the medial portion 72 of the resilient member 62 is provided with a spirally wound portion 74 in a central portion 76 thereof. Thus, the medial portion 72 of the resilient member 62 is provided with a V-shaped configuration substantially as shown in FIG. 5.

The hook 64 of the edge support 60 is connected to the first end portion 68 of the resilient member 62 so that the hook 64 is biased in a first position (as depicted in FIGS. 4–7 and 11) wherein the hook 64 is disposed substantially adjacent the plane of the lower frame 18. The hook 64 is movable from the first biased position as described above to a second position (as depicted in FIGS. 8, 9 and 11). In the second position the hook 64 is disposed substantially normal to the plane of the lower frame 18.

Figure 6:
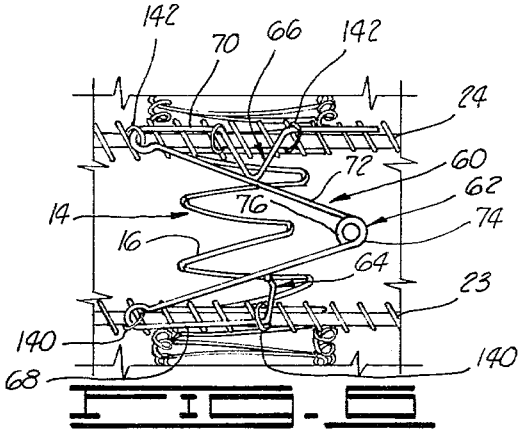
FIG. 6 is a fragmentary side view of the inner spring assembly and edge support of FIG. 5, the inner spring assembly and edge support being depicted in a compressed condition.
Figure 9:
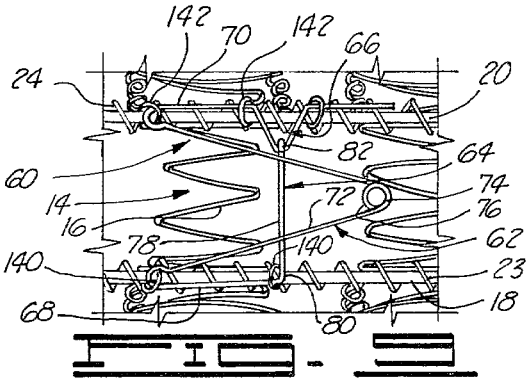
FIG. 9 is a fragmentary view of the inner spring assembly of FIG. 6 illustrating wherein the hook of the edge support is disposed in the second position and engaging the hook receiver for securing the inner spring assembly in the compressed condition.

The hook receiver 66 of the edge support 60 is adapted to engage the hook 64 when the hook 64 is in the second position and the lower and upper frames 18, 20 of the inner spring assembly 14 are in the compressed condition. The hook receiver 66 can be formed on the opposed second end portion 70 of the resilient member 62 (as depicted in FIGS. 5, 6 and 9); or the hook receiver 66 can be formed on the medial portion 72 of the resilient member 62 as depicted in FIG. 11.

Referring more specifically to FIGS. 4, 7, 9 and 11, the hook 64 of the edge support 60 comprises an elongated member 78 having a first end 80 and a hook-shaped opposed second end 82. The first end 80 of the elongated member 78 is connected to the first end portion 68 of the resilient member 62 such that in an assembled position the elongated member 78 of the hook 64 extends from the first end portion 68 of the resilient member 62 and into the space formed between the lower and upper frames 18, 20. Further, the elongated member 78 of the hook 64 is connected to and supported by the first end portion 68 of the resilient member 62 such that the elongated axis of the elongated member 78 is substantially normal to the elongated axis of the first end portion 68 of the resilient member 62, and the hook-shaped opposed second end 82 of the hook 64 extends in an upwardly direction from the plane of the lower frame 18.

As previously stated, the hook receiver 66 of the edge support 60 can be disposed on the opposed second end 70 of the resilient member 62 or on the medial portion 72 of the resilient member 62. However, regardless of where positioned, the hook receiver 66 must be alignable with the hook 64 when the hook 64 is in the second position so that upon compressing the lower and upper frames 18, 20 of the inner spring assembly 14, and moving the hook 64 to the second position, the hook receiver 66 can engage the hook 64 and secure the lower and upper frames 18, 20 of the inner spring assembly 14 in the compressed condition. The unique construction and interaction between the resilient member 62, the hook 64, and the hook receiver 66, coupled with the biasing of the hook 64 in the first position, as heretofore discussed, enables the hook receiver 66 to release the hook 64 when the lower and upper frames 18, 20 of the inner spring assembly 14 are moved to a second compressed condition, even when the cover 12 has been secured to the inner spring assembly 14 to substantially enclose the inner spring assembly 14 and form the mattress 10. In other words, since the hook 64 is biased in the first position, the hook 64 will automatically return to the first position when additional compressive pressure is applied to the lower and upper frames 18, 20 of the inner spring assembly 14 so as to cause the hook receiver 66 to release the hook 64. Upon release of the hook 64 from the hook receiver 66 the lower and upper frames 18, 20 are released so that they can expand within the boundaries of the cover 12.

Figure 11:
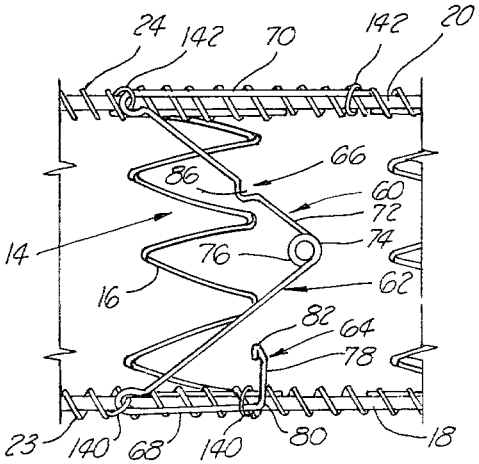
FIG. 11 is a fragmentary view of an inner spring assembly illustrating a side view of the edge support of the present invention wherein the hook is depicted in the biased first position and the hook receiver is formed on a medial portion of the resilient member of the edge support.

As more clearly illustrated in FIGS. 5 and 11, the edge support 60 is preferably formed as a unitary member. In such instance the hook receiver is formed as a depression 84 in the opposed second end portion 70 of the resilient member 62 (as shown in FIG. 5); or as a depression 86 formed in the medial portion 72 of the resilient member 62 (as shown in FIG. 11).

The improved edge support 60 of the present invention, when employed in combination with the inner spring assembly 14, enables one to readily cover the inner spring assembly 14 with the cover 12 to produce the mattress 10 having a uniform appearance in which the cover 12 is firmly positioned over the inner spring assembly 14. As shown in FIGS. 1 and 4, the cover 12 of the mattress 10 comprises an upper cover 90, a lower cover 92, and a side cover 94. The side cover 94 is provided with an upper side portion 96 and a lower side portion 98. The upper cover 90 is secured to the upper side portion 96 of the side cover 94 by a tape material 100; and the lower cover 92 is connected to the lower side portion 78 of the side cover 94 by a tape material 102. Thus, the upper cover 90, the lower cover 92, and the side cover 94, in combination with the tape materials 100, 102 substantially encapsulate the lower and upper frames 18, 20 of the inner spring assembly 14 to provide an upholstered product.

Figure 2:
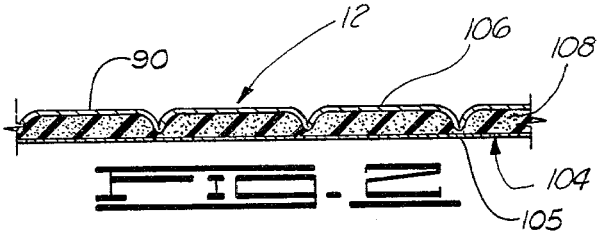
FIG. 2 is a fragmentary cross-sectional view of the mattress cover wherein the backing material of the cover is a high tensile strength material.

Referring now to FIG. 2, in combination with FIGS. 1 and 4, each of the upper cover 90, the lower cover 92, and the side cover 94 comprise a backing material 104, an outer ticking material 106, and a filler material 108 disposed therebetween. Thus, the cover 12 of FIGS. 1, 2 and 4, may be formed in any suitable manner, such as by enclosing a layer of the filler material 108 of suitable thickness between the backing material 104 and the ticking material 106 and thereafter quilting the backing material 104, the filler material 108, and the ticking material 106 together, preferably by gang stitching. Such procedures are well known in the upholstery art.

In constructing the cover 12 for the mattress 10 from the upper cover 90, the lower cover 92, and the side cover 94, the peripheral edges of the upper cover 90 and the upper side portion 96 of the side cover 94 are positioned adjacent each other in a facing relationship such that the edges point outwardly as depicted in FIG. 4. Thereafter a continuous tape material, such as the tape material 100, is folded over the doubled edges of the upper cover 90 and the upper side portion 96 of the side cover 94 so as to form and enfold the edges. A line of stitching (not shown) is then provided through the tape material 100 and the enfolded double edges of the upper cover 90 and the upper side portion 96 of the side cover 94 to provide a taped bead or rolled edge 112 as depicted in FIGS. 1 and 4. The lower cover 92 is likewise secured to the lower side portion 98 of the side cover 94 with the tape material 102 using the same procedures as set forth above to provide a taped bead or rolled edge 114 on the lower portion of the mattress 10 as shown.

Figure 3:
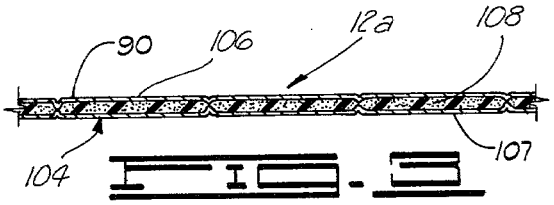
FIG. 3 is a fragmentary cross-sectional view of a mattress cover utilizing a conventional backing material.

As previously stated, when employing the improved edge support 60 of the present invention to secure the lower and upper frames 18, 20 of the inner spring assembly 14 in the compressed condition during the covering operation, one can employ as the backing material 104 (in the fabrication of the mattress cover 12) a high tensile strength backing material 105, as illustrated in FIG. 2, or a conventional backing material 107 (in the fabrication of the conventional mattress cover **12*a*) as illustrated in FIG. 3. The term "high tensile strength backing material" as used herein is to be understood to mean a backing material having a sufficient strength so that upon quilting the ticking material 106 to the high tensile strength backing material 105 a plush appearance is provided in the ticking material 106 and the backing material 105 is maintained in a substantially common plane and does not result in a quilted surface on the backing material (and thus a reduction in the quilted outer surface of the cover 12) as a result of the quilting and stretching the quilted cover 12 over the mattress. Further, by employing the high tensile strength backing material 105 in the fabrication of the cover 12 an excess of the ticking material 106 can be secured, via the quilting process, to the backing material 105. Thus, the net effect of employing the high tensile strength backing material 105 is to provide a more plush appearance to the quilted outer ticking material 106 as shown in FIG. 2, especially when compared to the usual effect obtained when using a conventional backing material 107 (as illustrated in FIG. 3) in the construction of the mattress cover 12*a***.

In addition to the beforementioned improved, plush quilting effect which can be obtained when employing the high tensile strength backing material 105 in fabricating the cover 12 as heretofore described, the use of such high tensile backing material 105 aids in securing handle assemblies, such as handle assembly 116, to the mattress 10 via the side cover 94 of the cover 12. The use of the high tensile strength backing material 105 in the fabrication of the mattress cover 12 overcomes the problems which have heretofore been encountered in the use of handles on mattresses employing the mattress cover 12*a*, i.e. the handles can easily be detached from the mattress fabricated with the mattress cover 12*a*. For example, these problems can be overcome by fabricating the cover 12 with the high tensile strength backing material 105 and employing a plurality of handle assemblies, such as the handle assembly 116 depicted in FIGS. 12, 13, and 14. Because each of the handle assemblies are substantially identical in construction, only a detailed description of handle assembly 116 will be set forth.

Figure 12:
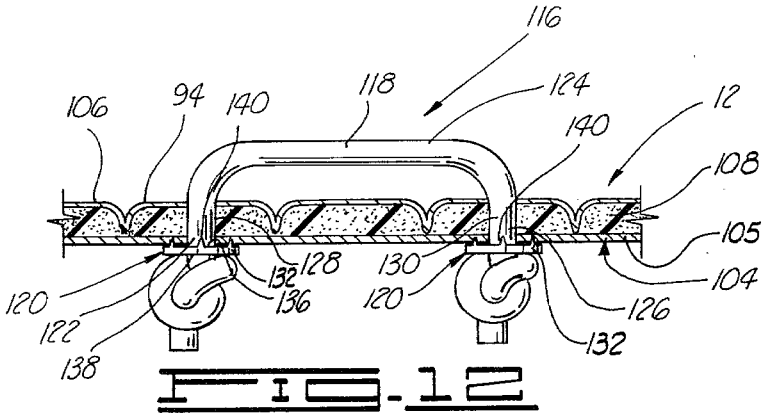
FIG. 12 is a fragmentary cross-sectional view of the mattress cover of FIG. 2 wherein the backing material is a high tensile strength material and the mattress is provided with a handle.
Figure 13:
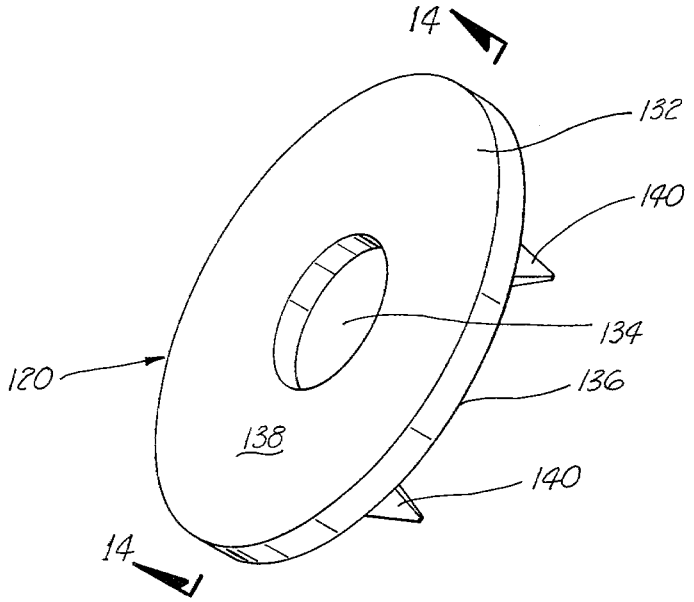
FIG. 13 is a perspective view of the reinforcing member of FIG. 12 employed to secure the handle to the side portion of the mattress cover.
Figure 14:
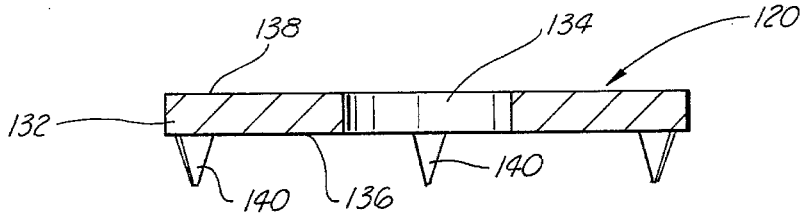
FIG. 14 is a cross-sectional view of the reinforcing member of FIG. 13.

As shown in FIGS. 12–14 the handle assembly 116 comprises a handle 118 and a reinforcing member 120. The handle 118 is provided with a first end portion 122, a medial portion 124, and a second end portion 126. The first end portion 122 of the handle member 118 is disposed through an opening 128 in a side cover 94 of the mattress cover 12 and secured to the high tensile backing material 105 of the side cover 104 via one of the reinforcing members 120; and the second end portion 126 of the handle 118 is disposed through an opening 130 in the side cover 94 of the mattress cover 12 (as shown in FIG. 12) and secured to the high tensile backing material 105 of the side cover 94 via one of the reinforcing members 120 such that the medial portion 124 of the handle 118 can be grasped to lift and move the mattress 10.

Each of the reinforcing members 120 comprises a plate 132 having a centrally positioned aperture 134 therein. The plate 132 is provided with a first side 136 and an opposed second side 138. The first side 136 of the plate 132, which is disposed adjacent the high tensile strength backing material 105 of the cover 12, is provided with a plurality of substantially pointed projecting members 140 extending therefrom. The projecting members 140 are adapted to engage the high tensile strength backing material 105 of the side cover 94 so that the plate 132 of the reinforcing member 120 is secured thereto. The first and second end portions 122, 126 of the handle 118 can be secured to the plate 132 of the reinforcing members 120 by any suitable means, such as providing a knot in the end thereof and the like. The unique combination of the reinforcing member 120 and the high tensile strength backing material 105 of the cover 12 prevent the handle 118 from becoming detached from the side cover 94 of the cover 12.

To assist in a complete understanding of the present invention the mode of operation of the improved edge support 60 to secure the lower and upper frames 18, 20 of the inner spring assembly 14 in the compressed condition while securing the cover 12 to the inner spring assembly 14 will now be explained with reference to 4–9 and 11. The first end portion 68 of the resilient member 62 of the edge support 60 is secured to the lower frame 18 by plurality of compressed ring members 140; and the second end portion 70 of the resilient member 62 is secured to the upper frame 20 by a plurality of compressed ring members 142. The resilient member 62 of the edge support 40 is secured to the lower and upper frames 18, 20 such that the hook 64 of the edge support 60 is disposed substantially adjacent the plane of the lower frame 18 and alignable with the hook receiver 66. To compress the lower and upper frames 18, 20 of the inner spring assembly 14 pressure is applied to one or both of the lower and upper frames 18, 20 of the inner spring assembly 14 until the lower and upper frames 18, 20 are compressed and spaced a predetermined distance apart. While the lower and upper frames 18, 20 of the inner spring assembly 14 are maintained in the compressed condition the hook 64 is moved from the biased first position to the second position and brought into engagement with the hook receiver 66. After the hook receiver 66 engaging the hook 64 the pressure is released from the lower and upper frames 18, 20 and the lower and and upper frames 18, 20 are secured in the compressed condition. The resulting compressed inner spring assembly 14 can can then be more easily covered.

Once the covering of the inner spring assembly 14 has been completed an additional amount of pressure is applied to one or both of the lower and upper frames 18, 20 of the inner spring assembly so as to further compress the lower and upper frames 18, 20. The further compression of the lower and upper frames 18, 20 of the inner spring assembly 14 causes the hook receiver 66 to release the hook 64 whereupon the hook 64 returns to the biased first position and the lower and upper frames 18, 20 of the inner spring assembly 14 expand because of the springs disposed therebetween, such as spring 16, and the resilient member 62 of the edge support 60. It should be noted that the lower and upper frames 18, 20 of the inner spring assembly 14 can be released from the compressed condition even though the inner spring assembly 14 has been substantially encapsulated by the cover 12.

It is clear that the present invention is well adapted to carry out the objects and attain the ends and advantages mentioned, as well as those inherent therein. While presently preferred embodiments have been described for the purpose of this disclosure, numerous changes may be made which will readily suggest themselves to those skilled in the art and which are encompassed within the spirit of the invention disclosed and as defined in the appended claims.

I claim:

1. An inner spring assembly comprising:

a peripheral upper frame;

a peripheral lower frame;

resilient means for connecting the upper and the lower frame and to support the upper frame and the lower frame in a spaced apart relationship, the resilient means adapted to permit the upper and the lower frame to be moved to a first compressed condition wherein the upper and lower frames can be spaced a predetermined distance apart;

a hook disposed near one of the upper and lower frame, the hook being biased in a first position such that the hook is disposed substantially adjacent the plane of the frame near which the hook is disposed, the hook being movable to a second position wherein the hook is disposed substantially normal to the plane of the frame near which the hook is disposed; and a hook receiver disposed near the other of the upper and lower frame, the hook receiver adapted to engage the hook when the hook is in the second position and the first and second frames are in the first compressed condition, the hook receiver further adapted to release the hook when the upper and lower frames are moved to a second compressed condition.

2. The inner spring assembly of claim 1 wherein the resilient means comprises a plurality of edge support members intermittently disposed along and connecting the upper frame and the lower frame, each of the edge support members comprising a resilient member having a first end portion, a spatially disposed second end portion, and a medial portion extending therebetween, the first end portion being disposed substantially adjacent and connected to a portion of the upper frame, the second end portion being connected to the lower frame, and the medial portion being angularly disposed between the first and second end portions such that the medial portion is movable between an extended first position and a compressed second position.

3. The inner spring assembly of claim 2 wherein the hook is supported by the first end portion of the resilient member and the hook receiver is supported by one of the second end portion and the medial portion of the resilient member.

4. The inner spring assembly of claim 3 wherein the resilient means further comprises a plurality of springs disposed between the upper and lower frames and wherein the inner spring assembly further comprises a plurality of connecting means for interconnecting the adjacent springs and for connecting the springs to the upper and lower frames.

5. The inner spring assembly of claim 3 wherein the angularly disposed medial portion of the resilient compressible member is wound to improve the resilient properties of such medial portion and provide a spring-like member.

6. The inner spring assembly of claim 2 wherein the hook comprises an elongated member having a first end and a hook-shaped opposed second end, the first end of the elongated member being connected to and supported by the first end portion of the resilient member such that the elongated member extends therefrom and into the space formed between the upper and lower frames.

7. The inner spring assembly of claim 5 wherein the elongated member of the hook is connected to and supported by the first end portion of the resilient member such that the elongated axis of the elongated member is substantially normal to the elongated axis of the first end portion of the resilient member, and the hook-shaped opposed second end of the hook extends in an upwardly direction from the plane of the lower frame.

8. The inner spring assembly of claim 6 wherein the resilient member, the hook, and the hook receiver are formed as a unitary member.

9. The inner spring assembly of claim 8 wherein the hook receiver is formed as a depressed portion in one of the first end and medial portion of the resilient member.

10. The inner spring assembly of claim 2 or 9 which further comprises padding means for covering the springs disposed between the upper and lower frames and the upper end lower frames.

11. The inner spring assembly of claim 10 which further comprises connecting means for securing the padding means to the springs disposed around the periphery of the upper and lower frames.

12. The inner spring assembly of claim 11 which further comprises cover means for covering the padding means and forming a substantially continuous exterior surface over the upper and lower frames.

13. The inner spring assembly of claim 12 wherein the cover means comprises:

an upper cover;

a lower cover;

a side cover having an upper side portion and a lower side portion;

a first tape material for securing the upper cover to the upper side of the side cover member; and a second tape material for securing the lower cover to the lower side of the side cover member such that in an assembled position of the upper cover, the lower cover and the side cover the cover means encapulates the upper and lower frames to provide an upholstered product.

14. The inner spring assembly of claim 13 wherein the upholstered product is a mattress.

15. The inner spring assembly of claim 14 wherein the upper cover, the lower cover and the side cover each comprises:

a higher tensile strength backing material;

an outer ticking material; and a filler material disposed therebetween.

16. The inner spring assembly of claim 15 wherein each of the backing material, the filling material and the outer ticking material are quilted and secured together to provide the outer ticking material with a quilted pattern.

17. The inner spring assembly of claim 16 which further comprises handle means disposed on the side cover of the mattress for allowing the mattress to be picked up and moved, the handle means comprising:

a plurality of handle members disposed along an exterior portion of the side cover, each of the handles having a first end portion, a medial portion, and a second end portion; and a plurality of reinforcing members disposed substantially adjacent the high tensile backing material, each of the reinforcing members adapted to engage the high tensile backing material, one of the reinforcing members adapted to receive the first end portion of a handle such that the first end portion of the handle can be secured thereto, another of the reinforcing members adapted to receive the second end portion of the handle such that the second end portion of the handle can be secured thereto so that in an assembled position the medial portion of the handle is disposed substantially adjacent the exterior portion of the side cover.

18. The inner spring assembly of claim 17 wherein at least two of the handle means are positioned on one side of the mattress and at least two of the handle means are positioned on an opposed side of the mattress.

19. The inner spring assembly of claim 18 wherein the reinforcing members each comprise:

a plate having a first side, an opposed second, and a substantially centrally positioned aperture;

a plurality of substantially pointed projecting members connected to the first side of the plate and extending therefrom, the projecting members adapted to engage the high tensile backing material of the side cover, the aperture adapted to receive one of the end portions of a handle.

20. An improved edge support for use with an inner spring assembly having a peripheral upper frame, a peripheral lower frame, and a plurality of springs interconnecting the upper frame to the lower frame in a spaced apart relationship, a plurality of the edge supports being disposed along and connected to the upper and lower frames for strengthening and supporting same, the edge supports adapted to permit the upper and lower frames to be selectively moved between a first expanded condition and a first compressed condition and to temporarily secure the upper and lower frames in the first compressed condition, each of the edge supports comprising:

a resilient member having a first end portion, a spatially disposed second end portion, and a medial portion extending therebetween, the first end portion being disposed substantially adjacent and connected to a portion of one of the upper frame and the lower frame, the second end portion being disposed substantially adjacent and connected to a portion of the other of the upper frame and the lower frame, and the medial portion being adapted to permit the upper and lower frame to be moved to the first compressd condition;

a hook connected to the first end portion of the resilient member, the hook being biased in a first position and movable between the first biased position and a second position wherein the hook is disposed substantially normal to the plane of the frame to which the first end portion of the resilient compressible member is connected; and a hook receiver formed on one of the second end portion and the medial portion of the resilient member, the hook receiver being substantially alignable with the hook and adapted to engage the hook when the hook is in the second position and the upper and lower frames are in the first compressed condition, the hook receiver further adapted to release the hook when the upper and lower frames are moved to a second compressed condition so that the hook returns to its first position and the upper and lower frames return substantially to the first expanded condition.

21. The improved edge support of claim 20 wherein the hook comprises an elongated member having a first end and a hook-shaped opposed second end, the first end of the elongated member being connected to and supported by the first end portion of the resilient member such that the elongated member extends therefrom and into the space formed between the upper and lower frames.

22. The improved edge support of claim 21 wherein the elongated member of the hook is connected to and supported by the first end portion of the resilient member such that the elongated axis of the elongated member is substantially normal to the elongated axis of the first end portion of the resilient member, and the hook-shaped opposed second end of the hook extends in an upwardly direction from the plane of the lower frame.

23. The improved edge support of claim 22 wherein the medial portion of the resilient member is angularly disposed with respect to the elongated axis of the first and second end portions of the resilient member so as to improve the resilient properties of such medial portion and provide a spring-like member.

24. The improved edge support of claim 23 wherein the medial portion of the resilient member is spirally wound in a central portion thereof and the medial portion has a substantial V-shaped configuration.

25. The improved edge support of claims 22, 23 or 24 wherein the resilient member, the hook, and the hook receiver are formed as a unitary member.

26. The inner spring assembly of claim 25 wherein the hook receiver is formed as a depressed portion in one of the first end and medial portion of the resilient member.

27. A self-releasing retaining assembly for use with an inner spring assembly having a peripheral upper frame, a peripheral lower frame, a plurality of springs interconnecting the upper and lower frames in a spaced apart relationship, and a plurality of edge supports disposed along and connected to the upper and lower frames, the retaining assembly adapted to secure the peripheral edge portions of the upper and lower frames in a first compressed condition during covering of the inner spring unit with a cover, and to release the peripheral edge portions of the upper and lower frame from the first compressed condition after the inner spring unit has been covered, the self-releasing retaining assembly comprising:

a hook secured to one of the upper and lower frames, the hook being biased in a first position such that the hook is disposed substantially adjacent the plane of the upper and lower frames to which the hook is secured, the hook being movable to a second position wherein the hook is disposed substantially normal to the plane of the upper and lower frame to which the hook is secured; and a hook receiver secured to the other of the upper and lower frames, the hook receiver adapted to retainingly engage the hook when the hook is moved to the second position and the peripheral edge portion of the upper and lower frames are moved to the first compressed condition, the hook receiver further adapted to release the hook after the inner spring unit has been covered by moving the upper and lower frames to a second compressed condition wherein the hook returns to its first position and the peripheral edge portions of the upper and lower frame expand as allowed by the confines of the cover.

28. In an inner spring assembly adapted to receive a cover to substantially enclose the inner spring assembly, the inner spring assembly including a peripheral upper frame, a substantially parallel spatially disposed peripheral lower frame, a plurality of springs disposed between the upper and lower frames, a plurality of transversely extending and longitudinally extending strap members for interconnecting the springs to the upper and lower frames, and a plurality of edge support members intermittently disposed along and connected to the peripheral upper and lower frames the edge supports permitting the upper and lower frames to be moved to a first compressed condition, each of the edge support members comprising:

a resilient member having a first end portion, a spatially disposed second end portion, and an angularly disposed medial portion extending therebetween, the first end portion being disposed substantially adjacent and connected to a portion of one of the upper and the lower frame, and the second end portion being disposed substantially adjacent and connected to a portion of the other of the upper and the lower frame;

a hook connected to the first end portion of the resilient member, the hook being biased in a first position such that the hook is disposed substantially adjacent the plane of the frame to which the first end portion of the resilient member is connected, the hook being movable from the first position to a second position wherein the hook is disposed substantially normal to the plane of the frame to which the first end portion of the resilient member is connected;

a hook receiver supported by one of the second end portion and the medial portion of the resilient member, the hook receiver being substantially alignable with the hook and adapted to engage the hook when the hook is in the second position and the upper and lower frames of the inner spring assembly are in the first compressed condition so that the cover can be positioned thereon and secured to enclose the inner spring assembly, the hook receiver further adapted to release the hook when the covered upper and lower frames are moved to a second compressed condition so that the hook returns to its first position and the upper and lower frames expand as allowed by the confines of the cover.

29. In the inner spring assembly of claim 28 wherein the hook is supported by the first end portion of the resilient member and the hook receiver is supported by one of the second end portion and the medial portion of the resilient member.

30. In the inner spring assembly of claim 29 wherein the hook comprises an elongated member having a first end and a hook-shaped opposed second end, the first end of the elongated member being connected to and supported by the first end portion of the resilient member such that the elongated member extends therefrom and into the space formed between the upper and lower frames.

31. In the inner spring assembly of claim 30 wherein the elongated member of the hook is connected to and supported by the first end portion of the resilient member such that the elongated axis of the elongated member is substantially normal to the elongated axis of the first end portion of the resilient member, and the hook-shaped opposed second end of the hook extends in an upwardly direction from the plane of the lower frame.

32. In the inner spring assembly of claim 31 wherein the medial portion of the resilient member is angularly disposed with respect to the elongated axis of the first and second end portions of the resilient member so as to improve the resilient properties of such medial portion and provide a spring-like member.

33. In the inner spring assembly of claim 32 wherein the medial portion of the resilient member is spirally wound in a central portion thereof and the medial portion has a substantial V-shaped configuration.

34. In the inner spring assembly of claim 32 or 33 wherein the resilient member, the hook, and the hook receiver are formed as a unitary member.

35. In the inner spring assembly of claim 34 wherein the hook receiver is formed as a depressed portion in one of the first end and medial portion of the resilient member.

* * * * *

UNITED STATES PATENT AND TRADEMARK OFFICE

CERTIFICATE OF CORRECTION

PATENT NO. : 4,326,311

DATED : April 27, 1982

INVENTOR(S) : Michael D. Paripovich

It is certified that error appears in the above-identified patent and that said Letters Patent are hereby corrected as shown below:

Column 11, line 60, the word "end" should be --and--.

Signed and Sealed this

*Seventh* Day of *September 1982*

[SEAL]

*Attest:*

GERALD J. MOSSINGHOFF

*Attesting Officer*

*Commissioner of Patents and Trademarks*